US009057381B2

(12) United States Patent
Chang et al.

(10) Patent No.: US 9,057,381 B2
(45) Date of Patent: Jun. 16, 2015

(54) COOLING FAN HAVING MAGNETICALLY POSITIONED SHAFT

(75) Inventors: Bor-Haw Chang, New Taipei (TW); Shu-Fan Liu, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 213 days.

(21) Appl. No.: 13/343,270

(22) Filed: Jan. 4, 2012

(65) Prior Publication Data

US 2013/0171016 A1 Jul. 4, 2013

(51) Int. Cl.

| | |
|---|---|
| ***F04B 35/04*** | (2006.01) |
| ***F04D 25/06*** | (2006.01) |
| ***F04D 29/056*** | (2006.01) |
| ***F04D 29/06*** | (2006.01) |

(52) U.S. Cl.

CPC ..... *F04D 25/0626* (2013.01); *F04D 29/056* (2013.01); *F04D 29/06* (2013.01); *F04D 25/062* (2013.01)

(58) Field of Classification Search

CPC ... F04D 25/06; F04D 25/062; F04D 25/0626; F04D 27/02; F04D 29/06; F04D 29/056

USPC ..... 417/423.1, 423.13; 384/446

See application file for complete search history.

(56) References Cited

U.S. PATENT DOCUMENTS

| | | | | |
|---|---|---|---|---|
| 3,384,427 | A * | 5/1968 | McHugh | 310/90.5 |
| 6,340,854 | B1 * | 1/2002 | Jeong | 310/90 |
| 6,356,408 | B1 * | 3/2002 | Nii et al. | 360/98.07 |
| 6,567,268 | B1 * | 5/2003 | Hsieh | 361/695 |
| 6,700,241 | B1 * | 3/2004 | Horng et al. | 310/67 R |
| 6,982,505 | B2 * | 1/2006 | Horng et al. | 310/51 |
| 7,038,341 | B1 * | 5/2006 | Wang et al. | 310/90.5 |
| 7,210,226 | B2 * | 5/2007 | Makinson et al. | 29/889.23 |
| 7,729,118 | B2 * | 6/2010 | Lai et al. | 361/699 |
| 7,825,558 | B2 * | 11/2010 | Jungmayr et al. | 310/90.5 |
| 2007/0024137 | A1 * | 2/2007 | Otsuki et al. | 310/90 |

* cited by examiner

*Primary Examiner* — Bryan Lettman
*Assistant Examiner* — Timothy P Solak
(74) *Attorney, Agent, or Firm* — C. G. Mersereau; Nikolai & Mersereau, P.A.

(57) ABSTRACT

An oil-retaining bearing fan structure includes a fan base seat, an oil-retaining bearing and a fan impeller. The fan base seat has a bearing cup on one side. At least one magnetic member is enclosed in the bearing cup. The magnetic member serves to apply a magnetic attraction force to a shaft of the fan structure to make the shaft quickly restore to its optimal operation position so as to reduce wear and lower the noises and vibration of the fan structure in operation. Therefore, the lifetime of the fan structure can be prolonged.

2 Claims, 7 Drawing Sheets

COOLING FAN HAVING MAGNETICALLY POSITIONED SHAFT

BACKGROUND OF THE INVENTION

1. Field of the Invention

The present invention relates generally to an improved oil-retaining bearing fan structure, and more particularly to an oil-retaining bearing fan structure capable of reducing wear and lowering noises and vibration to prolong the lifetime of the fan structure.

2. Description of the Related Art

Recently, all kinds of electronic information products (such as computers) have been more and more popularly used and widely applied to various fields. There is a trend to increase processing speed and expand access capacity of the electronic information products. Therefore, the electronic components of the electronic information products have operated at higher and higher speed. When operating at high speed, the electronic components generate high heat at the same time.

With a computer host taken as an example, the central processing unit (CPU) in the computer host generates most of the heat generated by the computer host in operation. In case the heat is not efficiently dissipated, the temperature of the CPU will rise very quickly to cause deterioration of the execution efficiency. When the accumulated heat exceeds a tolerable limit, the computer will crash or even burn down in some more serious cases.

Moreover, for solving the problem of electromagnetic radiation, the computer host is often enclosed in a computer case. This will affect the dissipation of the heat generated by the computer host. Therefore, it has become a critical issue how to quickly conduct out and dissipate the heat generated by the CPU and other heat-generating components.

Conventionally, a heat sink and a cooling fan are arranged on the CPU to quickly dissipate heat. One side of the heat sink has multiple radiating fins, while the other side of the heat sink is free from any radiating fin. The surface of the other side of the heat sink directly contacts the CPU for conducting heat to the radiating fins. The radiating fins serve to dissipate the heat by way of radiation. In addition, the cooling fan cooperatively forcedly drives airflow to quickly carry away the heat.

FIG. 1 is a perspective sectional assembled view of a conventional oil-retaining bearing cooling fan. The cooling fan 1 includes a fan base seat 11. A bearing cup 111 protrudes from the fan base seat 11. A bearing 12 is disposed in the bearing cup 111. A fan impeller 13 is assembled with the fan base seat 11. The fan impeller 13 has multiple blades 131 annularly arranged along outer circumference of the fan impeller 13. The fan impeller 13 further has a shaft 132 extending from an inner side of the fan impeller 13. The shaft 132 is disposed and located in the bearing 12. An oil film 121 is filled between the bearing 12 and the shaft 132. The relative position between the fan base seat 11, the bearing 12 and the fan impeller 13 is tested and adjusted to an optimal operation position where the shaft 132 of the cooling fan 1 can stably rotate within the bearing 12 under support of the oil film 121. Accordingly, in operation of the cooling fan 1, the shaft 132 rotates within the bearing 12 in an operation position relative to the bearing 12 only under the support force of the oil film 121. However, the support force of the oil film 121 provided for the shaft 132 is smaller than the eccentric force applied to the shaft 132 in operation of the cooling fan 1. Therefore, the shaft 132 and the bearing 12 will still abrade and collide each other. Also, in case the cooling fan 1 is collided by an alien article to make the shaft 132 deflected from its true position, the shaft 132 will collide the bearing 12 and vibrate in operation. Under such circumstance, in operation, the cooling fan 1 will vibrate and make noises due to the deflection of the shaft 132. Moreover, the wear between the shaft 132 and the bearing 12 will be increased to shorten lifetime of the cooling fan 1. The shaft 132 may be restored to its optimal operation position under the support force of the oil film 121. However, after squeezed, it takes longer time for the oil film 121 to recover so that the shaft 132 also needs longer time to restore to its optimal operation position. As a result, the lasting time of the noises and wear will be longer.

According to the above, the conventional oil-retaining bearing cooling fan has the following shortcomings:

1. The conventional oil-retaining bearing cooling fan tends to vibrate and make noises.
2. The conventional oil-retaining bearing cooling fan is more subject to wear.
3. The noises made by the conventional oil-retaining bearing cooling fan will last longer.
4. The lifetime of the conventional oil-retaining bearing cooling fan is shorter.

SUMMARY OF THE INVENTION

A primary object of the present invention is to provide an improved oil-retaining bearing fan structure including at least one magnetic member. The magnetic member serves to apply a magnetic attraction force to a shaft of the fan structure to make the shaft quickly restore to its optimal operation position so as to reduce wear and lower the noises and vibration of the fan structure in operation. Therefore, the lifetime of the fan structure can be prolonged.

A further object of the present invention is to provide the above oil-retaining bearing fan structure, which can quickly restore to a stably operating state.

To achieve the above and other objects, the oil-retaining bearing fan structure of the present invention includes a fan base seat, an oil-retaining bearing and a fan impeller. The fan base seat has a bearing cup on one side. The bearing cup has a bearing hole. At least one magnetic member is enclosed in the bearing cup. The oil-retaining bearing is disposed in the bearing hole. The oil-retaining bearing has a shaft hole. The fan impeller has multiple blades and a shaft. The shaft is rotatably disposed in the shaft hole. The magnetic member serves to apply a magnetic attraction force to the shaft to make the shaft quickly restore to its optimal operation position so as to reduce wear and lower the noises and vibration of the fan structure in operation. Therefore, the lifetime of the fan structure can be prolonged.

According to the above arrangement, the present invention has the following advantages:

1. The noises and vibration of the fan structure are lowered.
2. The wear of the fan structure is reduced.
3. The lasting time of the noises is shortened.
4. The lifetime of the fan structure is prolonged.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
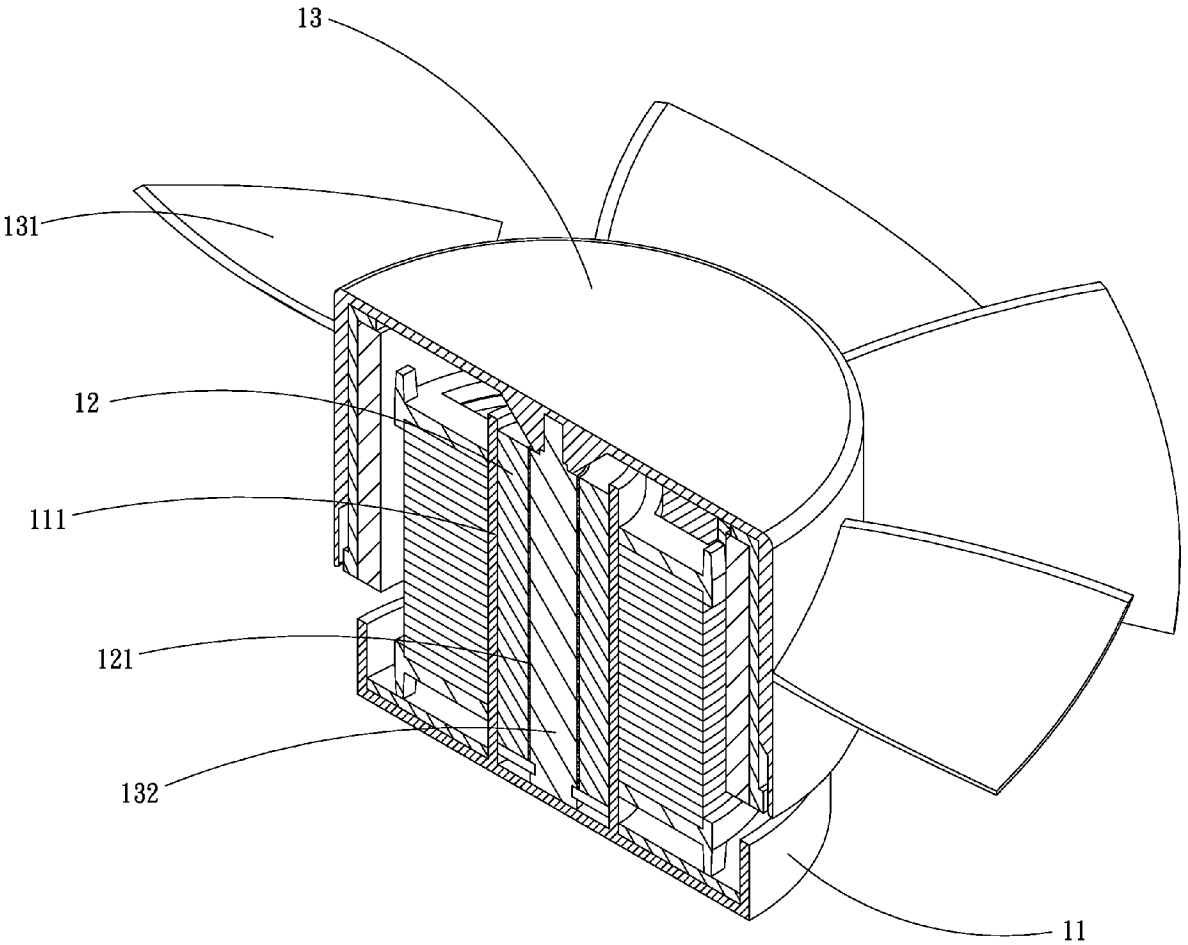
(PRIOR ART) Fig. 1
FIG. 1 is a perspective sectional assembled view of a conventional oil-retaining bearing cooling fan.
Figure 2:
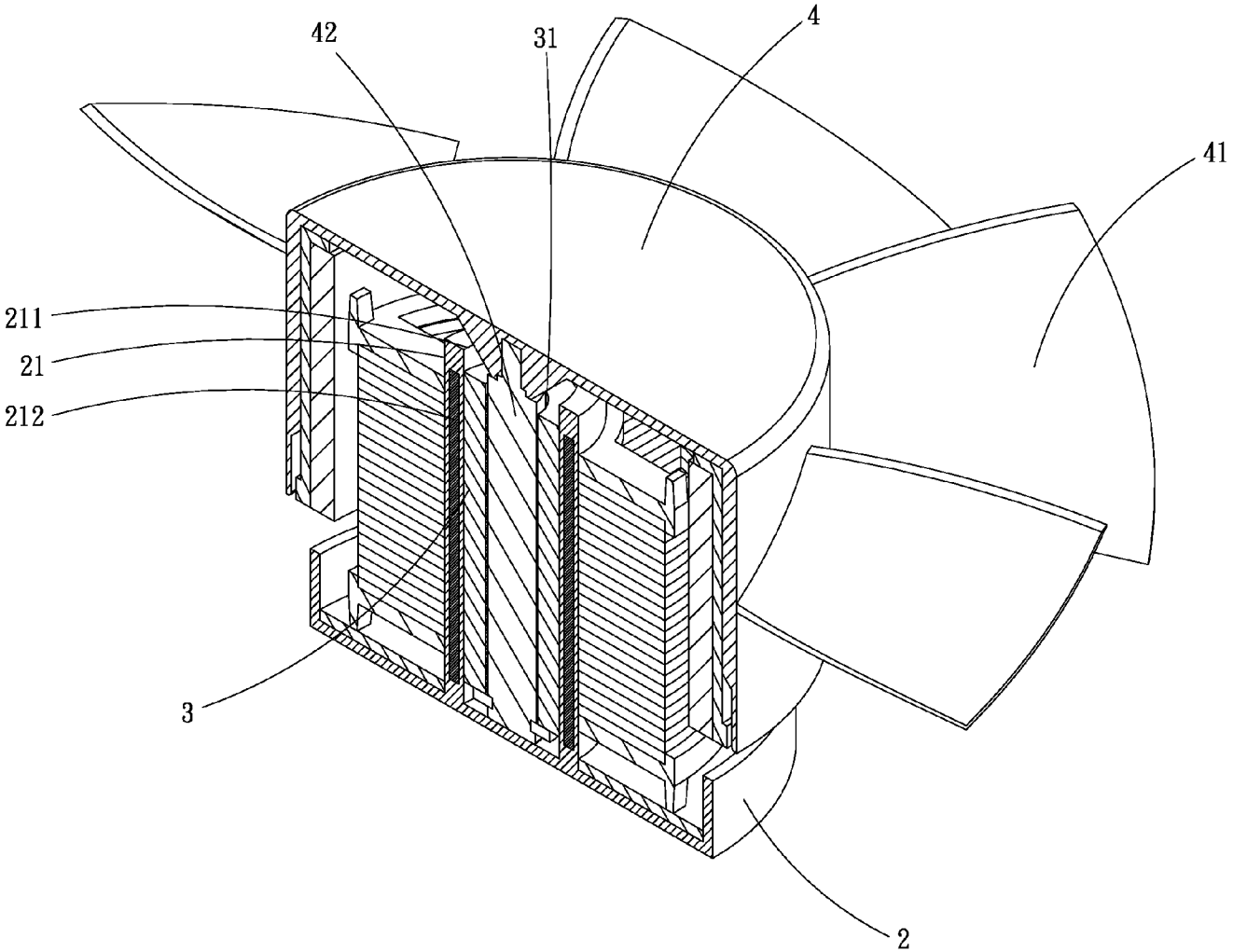
FIG. 2 is a perspective sectional assembled view of a first embodiment of the present invention.
Figure 3:
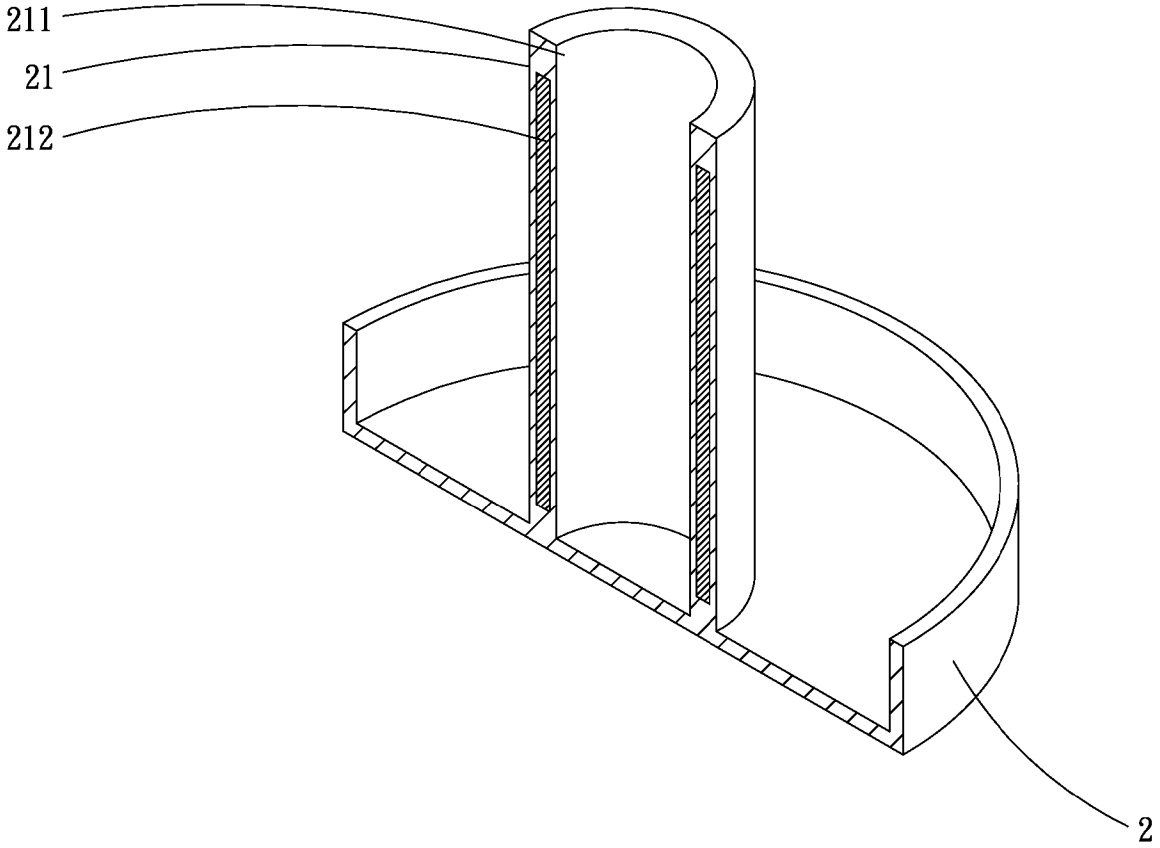
FIG. 3 is a perspective sectional assembled view of a part of the first embodiment of the present invention.

Please refer to FIGS. 2 and 3. FIG. 2 is a perspective sectional assembled view of a first embodiment of the present invention. FIG. 3 is a perspective sectional assembled view of a part of the first embodiment of the present invention. According to the first embodiment, the oil-retaining bearing fan structure of the present invention includes a fan base seat 2, an oil-retaining bearing 3 and a fan impeller 4. The fan base seat 2 has a bearing cup 21 on one side. The bearing cup 21 has an internal bearing hole 211. At least one magnetic member 212 is enclosed in the bearing cup 21. The magnetic member 212 is arranged in accordance with the configuration of the bearing cup 21 and is enclosed in the bearing cup 21 when the bearing cup 21 is formed. Alternatively, multiple magnetic members 212 are arranged in accordance with the configuration of the bearing cup 21 and are totally enclosed in the bearing cup 21 when the bearing cup 21 is formed. In this embodiment, one single magnetic member 212 is enclosed in the bearing cup 21. The magnetic member 212 is selected from a group consisting of magnetic iron, magnetic powder body and magnet. The oil-retaining bearing 3 is disposed in the bearing hole 211. The oil-retaining bearing 3 has a shaft hole 31. The fan impeller 4 includes multiple blades 41 and a shaft 42. The shaft 42 is rotatably disposed in the shaft hole 31. A hydraulic layer, which is an oil film, is filled between the shaft 42 and a wall of the shaft hole 31. When mounting the shaft 42 into the shaft hole 31, it is necessary to test and adjust the relative position between the fan base seat 2, the oil-retaining bearing 3 and the fan impeller 4 to an optimal operation position. When adjusting the position, the magnetic member 212 enclosed in the bearing cup 21 applies a magnetic attraction force to the shaft 42. In the meantime, the hydraulic layer provides a support force for the shaft 42. By means of the magnetic attraction force of the magnetic member 212 and the support force of the hydraulic layer, the shaft 42 can be effectively located in the optimal operation position. In operation of the fan impeller 4, under the magnetic attraction force of the magnetic member 212, the shaft 42 can be kept in the optimal operation position. Accordingly, the stability of operation of the shaft 42 within the oil-retaining bearing 3 can be enhanced to reduce wear and lower the noises and vibration of the fan structure in operation. Therefore, the lifetime of the fan structure can be prolonged.

On the other hand, in case in the oil-retaining bearing fan structure 2 is collided by an alien article to make the shaft 42 deflect from its true position, the shaft 42 will collide the oil-retaining bearing 3 and vibrate. Under such circumstance, the magnetic member 212 will apply a magnetic attraction force to the shaft 42, making the shaft 42 quickly restore to its optimal operation position so as to reduce wear and lower the noises and vibration of the fan structure in operation. Therefore, the lifetime of the fan structure can be prolonged.

Figure 4:
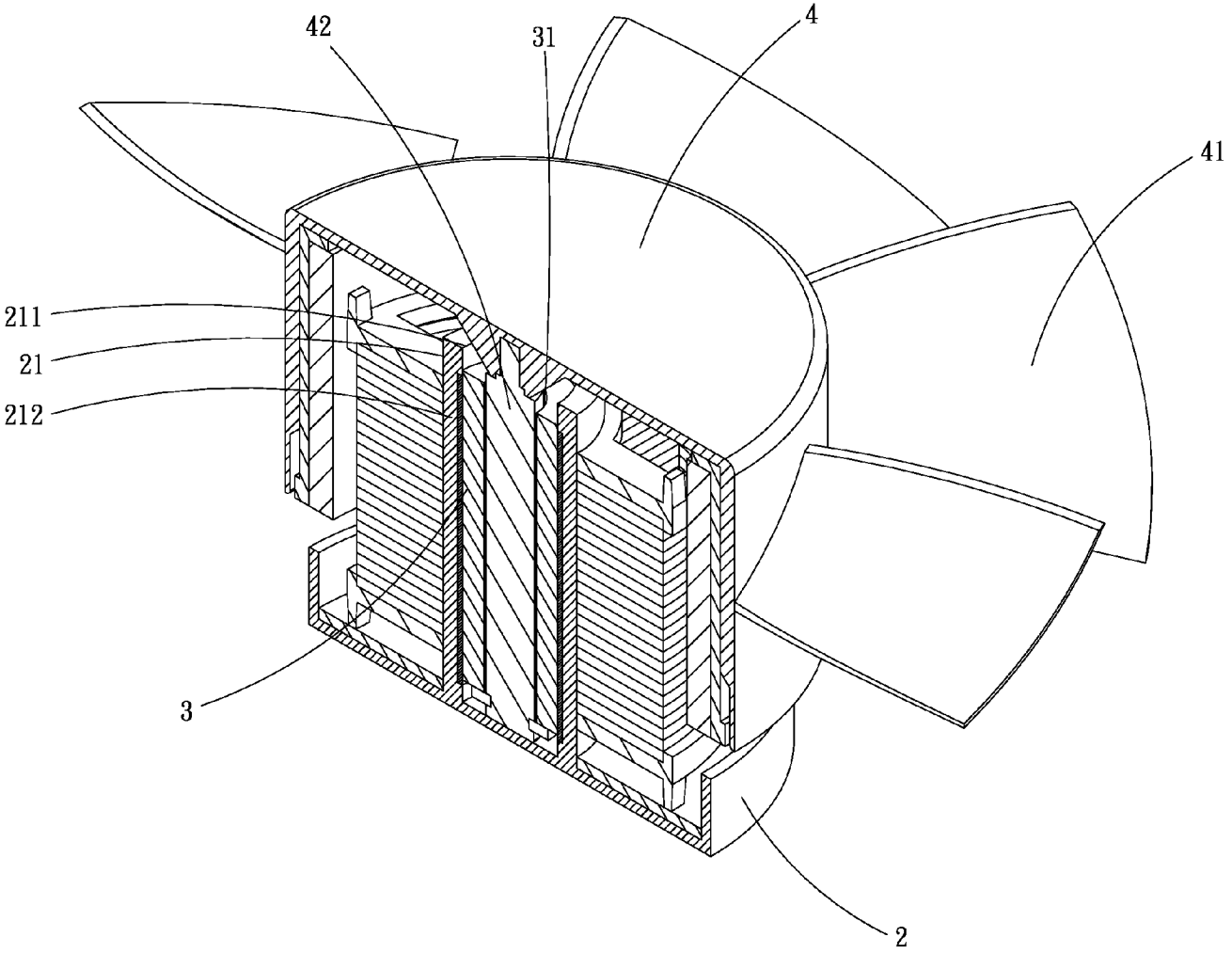
FIG. 4 is a perspective sectional assembled view of a second embodiment of the present invention.
Figure 5:
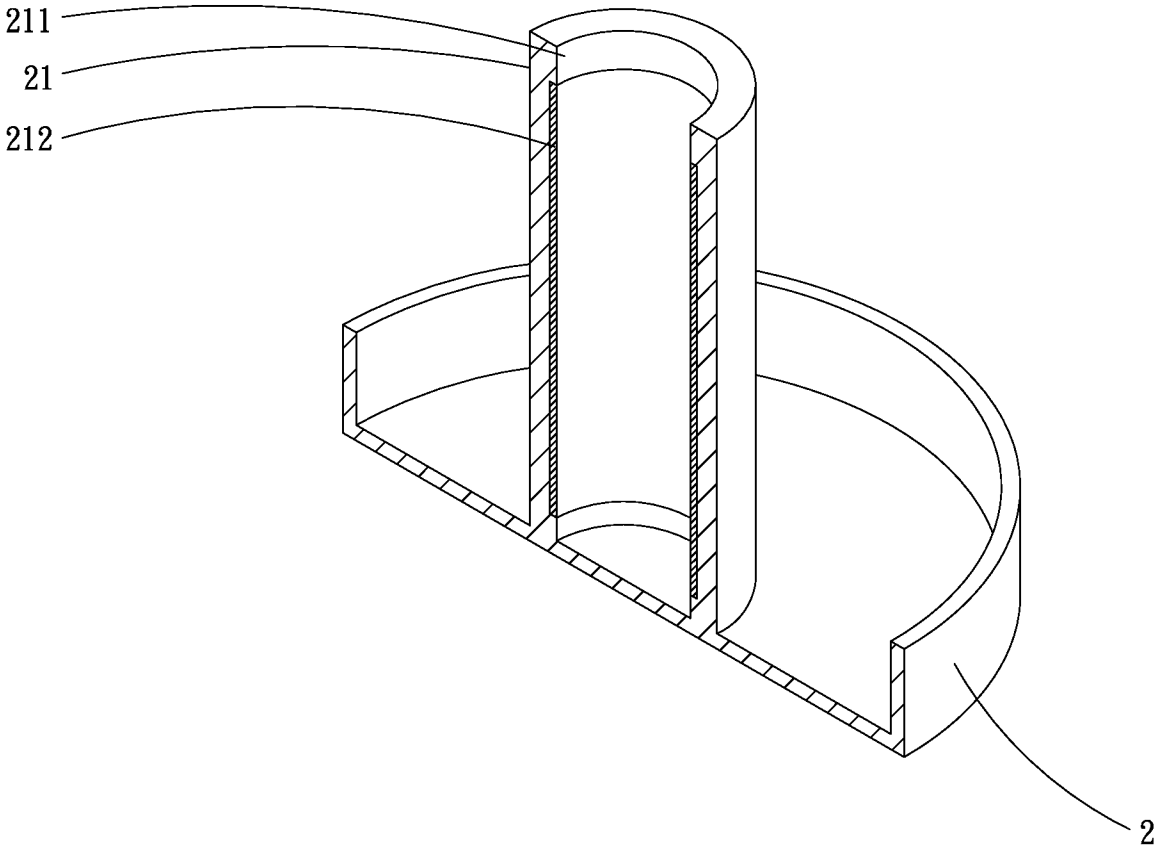
FIG. 5 is a perspective sectional assembled view of a part of the second embodiment of the present invention.

Please refer to FIGS. 4 and 5. FIG. 4 is a perspective sectional assembled view of a second embodiment of the present invention. FIG. 5 is a perspective sectional assembled view of a part of the second embodiment of the present invention. The second embodiment is substantially identical to the first embodiment in component, connection relationship and operation and thus will not be repeatedly described hereinafter. The second embodiment is different from the first embodiment in that the magnetic member 212 is arranged in accordance with the configuration of the bearing cup 21. Alternatively, the magnetic member 212 is arranged in accordance with the configuration of the bearing hole 211 of the bearing cup 21 or the configuration of a circumferential wall of the bearing hole 211 and is enclosed when the bearing cup 21 is formed. In this embodiment, the magnetic member 212 is enclosed in the bearing cup 21 when the bearing cup 21 is formed. One side of the magnetic member 212 is correspondingly open to the bearing hole 211. The shaft 42 is rotatably disposed in the shaft hole 31. The hydraulic layer is filled between the shaft 42 and the wall of the shaft hole 31. When mounting the shaft 42 into the shaft hole 31, it is necessary to test and adjust the relative position between the fan base seat 2, the oil-retaining bearing 3 and the fan impeller 4 to an optimal operation position. When adjusting the position, the magnetic member 212 enclosed in the bearing cup 21 applies a magnetic attraction force to the shaft 42. In the meantime, the hydraulic layer provides a support force for the shaft 42. By means of the magnetic attraction force of the magnetic members 212 and the support force of the hydraulic layer, the shaft 42 can be effectively located in the optimal operation position. In operation of the fan impeller 4, under the magnetic attraction force of the magnetic members 212, the shaft 42 can be kept in the optimal operation position. Accordingly, the stability of operation of the shaft 42 within the oil-retaining bearing 3 can be enhanced to reduce wear and lower the noises and vibration of the fan structure in operation. Therefore, the lifetime of the fan structure can be prolonged. On the other hand, in case in the oil-retaining bearing fan structure is collided by an alien article to make the shaft 42 deflect from its true position to collide the oil-retaining bearing 3 and vibrate, the magnetic members 212 will apply a magnetic attraction force to the shaft 42 to make the shaft 42 quickly restore to its optimal operation position so as to reduce wear and lower the noises and vibration of the fan structure in operation. Therefore, the lifetime of the fan structure can be prolonged.

Figure 6:
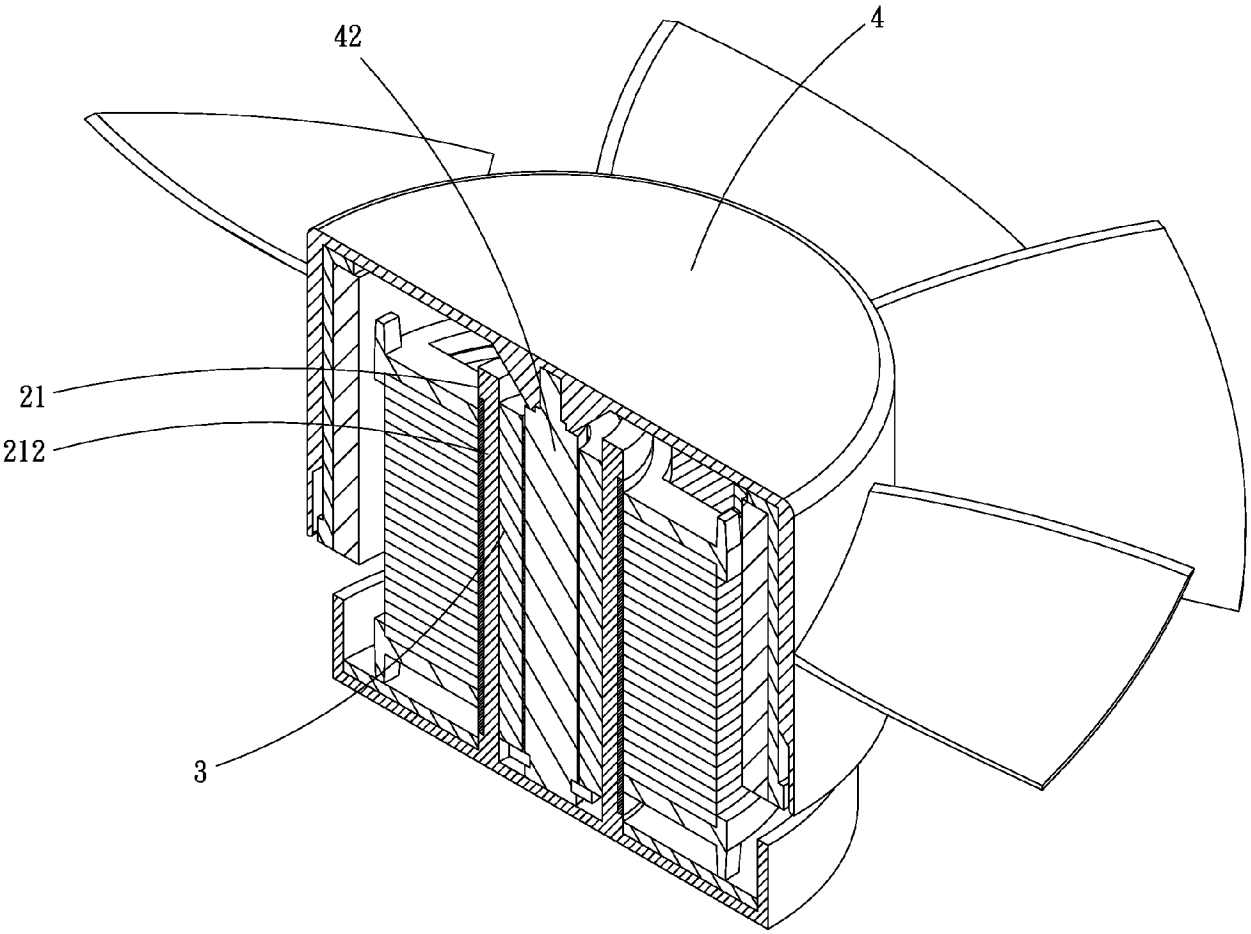
FIG. 6 is a perspective sectional assembled view of a third embodiment of the present invention.
Figure 7:
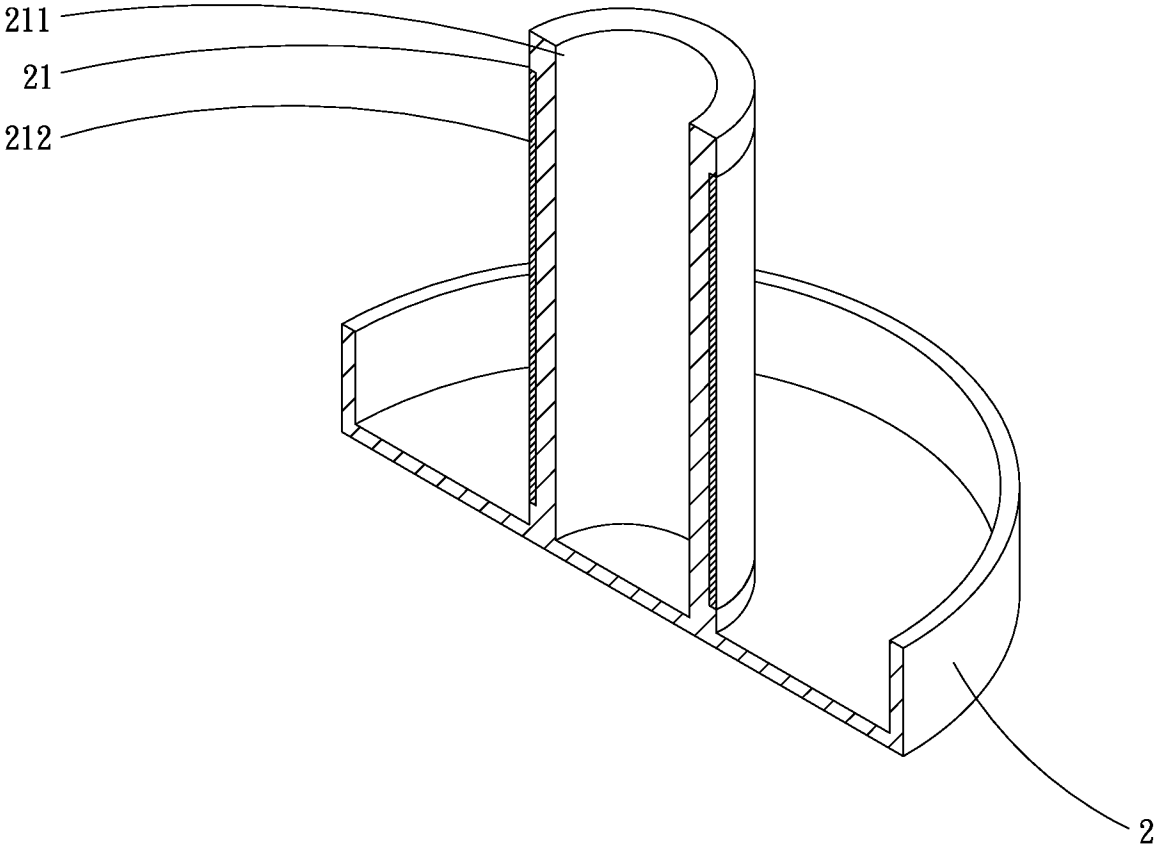
FIG. 7 is a perspective sectional assembled view of a part of the third embodiment of the present invention.

Please refer to FIGS. 6 and 7. FIG. 6 is a perspective sectional assembled view of a third embodiment of the present invention. FIG. 7 is a perspective sectional assembled view of a part of the third embodiment of the present invention. The third embodiment is substantially identical to the first embodiment in component, connection relationship and operation and thus will not be repeatedly described hereinafter. The third embodiment is different from the first embodiment in that the magnetic member 212 is enclosed in the bearing cup 21. In this embodiment, one side of the magnetic member 212 is correspondingly open to outer circumference of the bearing cup 21. The shaft 42 is located in the optimal operation position by means of the magnetic member 212. In operation of the fan impeller 4, under the magnetic attraction force of the magnetic member 212, the shaft 42 can be kept in the optimal operation position. Accordingly, the stability of operation of the shaft 42 within the oil-retaining bearing 3 can be enhanced to reduce wear and lower the noises and vibration of the fan structure in operation. Therefore, the lifetime of the fan structure can be prolonged.

The above embodiments are only used to illustrate the present invention, not intended to limit the scope thereof. It is understood that many changes and modifications of the above embodiments can be made without departing from the spirit of the present invention. The scope of the present invention is limited only by the appended claims.

What is claimed is:

1. An oil-retaining bearing fan structure comprising:

a fan base seat having a bearing cup on one side, the bearing cup having a receiving space and a bearing hole formed on an inside wall of the bearing cup, at least one elongate magnetic member being enclosed in the receiving space of the bearing cup the at least one elongate magnetic member being integral with and extending essentially along the length of the bearing cup;

an oil-retaining bearing disposed in the bearing hole, the oil-retaining bearing having a shaft hole and one lateral side of the oil-retaining bearing being attached to the elongate magnetic member;

a fan impeller having multiple blades and a shaft, the shaft being rotatably disposed in the shaft hole; and wherein the bearing cup and elongate magnetic member extend essentially along the entire length of the shaft;

wherein a hydraulic layer is filled between the shaft and a wall of the shaft hole; and wherein one side of the elongate magnetic member is correspondingly open to the bearing hole, and another side of the elongate magnetic member is enclosed in the bearing cup.

2. The oil-retaining bearing fan structure as claimed in claim 1, wherein the magnetic member is selected from a group consisting of magnetic iron, magnetic powder body.

* * * * *